US006460974B1

(12) United States Patent
Lebron

(10) Patent No.: US 6,460,974 B1
(45) Date of Patent: Oct. 8, 2002

(54) MICRO-PUMP AND METHOD FOR GENERATING FLUID FLOW

(75) Inventor: Hector Lebron, San Diego, CA (US)

(73) Assignee: Hewlett-Packard Company, Palo-Alto, CA (US)

( * ) Notice: Subject to any disclaimer, the term of this patent is extended or adjusted under 35 U.S.C. 154(b) by 0 days.

(21) Appl. No.: 09/917,571

(22) Filed: Jul. 27, 2001

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS

| | | | |
|---|---|---|---|
| 4,719,477 | A | 1/1988 | Hess |
| 5,317,346 | A | 5/1994 | Garcia |
| 5,517,224 | A | 5/1996 | Kaizu |
| 5,541,629 | A | 7/1996 | Saunders |
| 5,732,168 | A | 3/1998 | Donald |
| 5,815,180 | A | 9/1998 | Barbour |
| 5,835,112 | A | 11/1998 | Whitlock |
| 5,874,974 | A | 2/1999 | Courian |

*Primary Examiner*—Raquel Yvette Gordon

(57) ABSTRACT

Among the embodiments of the micro-pump herein described, the first includes an array containing a plurality of conductive elements. A plate covers the array and a controller supplies and controls current to the conductive elements in the array. In this embodiment, the plate can be, and preferably is, a photopolymer. Moreover, if a photopolymer is used, it is preferable to use a thin-film photopolymer having a sub-millimeter thickness. The conductive elements can have a current individually and sequentially applied therethrough or shut-off thereto by the controller. In addition, the controller operates to temporarily apply current to substantially all of the conductive elements in the array thereby enabling a fluid disposed on the plate to be separated into positively and negatively charged fluid molecules. Following this separation, the controller applies a current sequentially through selective of the conductive elements and shuts-off current thereto in a predetermined order to define a fluid flow path. A fluid disposed on the plate and separated into positively and negatively charged molecules is forced to move along the fluid flow path by a moving electromagnetic field generated by the application of current and shutting-off of current to the selective of the conductive elements. Moreover, the fluid follows the direction of the moving electromagnetic field.

18 Claims, 11 Drawing Sheets

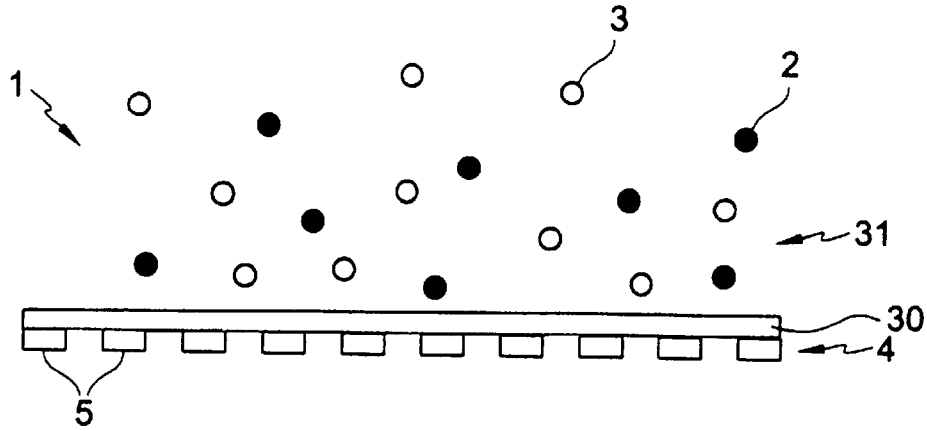
FIG.1(a)
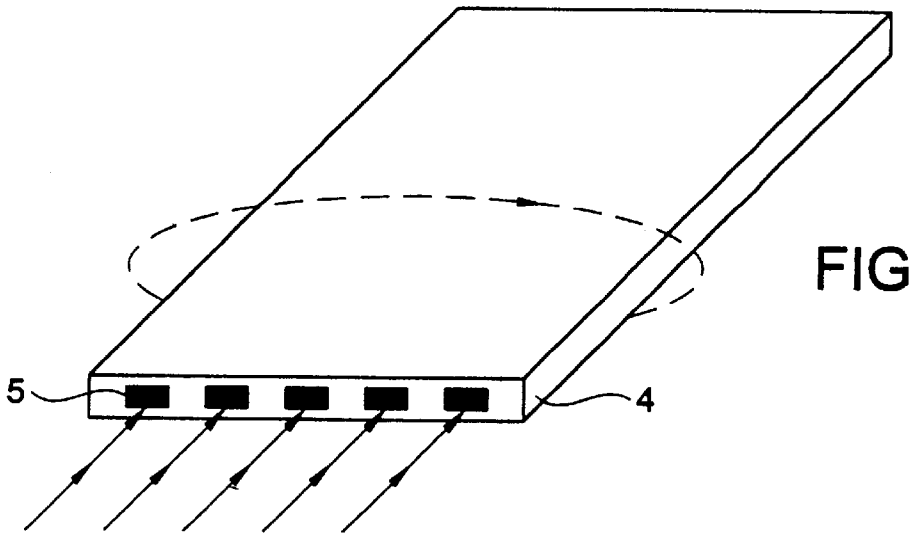
FIG.1(b)
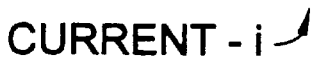
FIG.1(c)
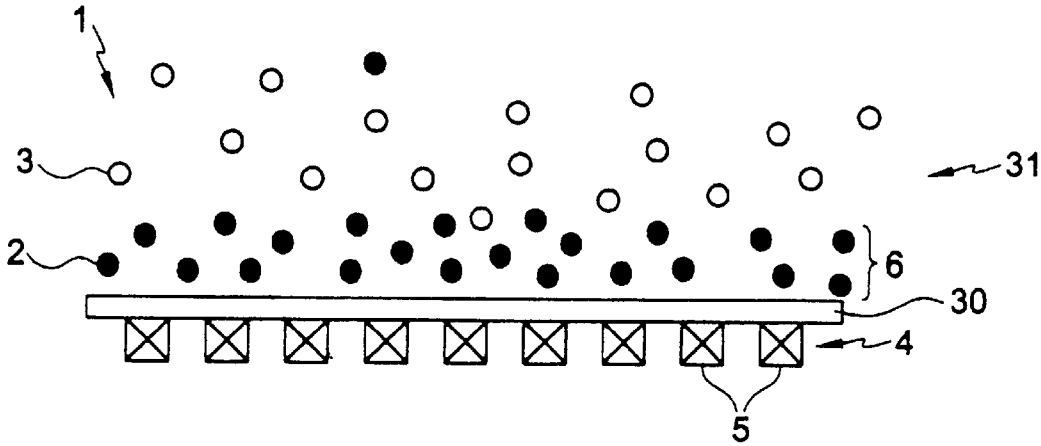

MICRO-PUMP AND METHOD FOR GENERATING FLUID FLOW

BACKGROUND OF THE INVENTION

1. Field of the Invention

This invention relates to the field of micro-pumps used to forcedly cause sub-microliter amounts of fluid to flow in a predetermined flow pattern. Micro-pumps of this nature are used to circulate ink in print heads and could be used in other arenas such as in the medical field in which bodily fluid flow could be controlled during medical procedures or by medical intervention. More specifically, this invention relates to micro-pumps using a series of conductive elements, which are arranged in an array or in a matrix and are selectively and sequentially charged and discharged at a high frequency, to create a moving electromagnetic field which pulls charged fluid molecules in a predetermined direction.

2. Description of the Related Art

Some micro-pumps use a series of resistors with a similar design to that used in thermal ink jets. These pumps use a first resistor to evaporate fluid and thereby create a bubble that clogs a microchannel. Firing a second adjacent resistor forces the fluid to move away from the clogged channel section. An inherent disadvantage in this approach is that the evaporation of the fluid, to generate the necessary work, could cause a kogation (i.e., residue) to deposited on the resistors when the fluid in the device is repeatedly heated. The occurrence of a kogation is particularly possible when transporting fluids such as inks; as is well known in the art of inkjet printers a kogation of ink is deposited on thermal inkjet resistors when the ink is heated during millions of print cycles. Moreover, resistor life is impacted by the potential for cavitation of the bubbles collapsing and by the related thermal cycling they undergo. Furthermore, in the medical context, evaporation and/or heating of the fluid can present unacceptable treatment conditions, as the properties of the fluid are likely to change.

Another type of micro-pump uses electro-osmosis. With this type of pump, a large steady-state magnetic field is applied to one end of a fluid causing it to move due to the biased electric charge in each of the atoms in the fluid. This approach, however, does not provide for a predetermined fluid flow path, nor does it provide the ability to localize the magnetic field. In addition, the fluid flow generated through electro-osmosis is very slow as its movement is based solely on charge differentiation.

Accordingly, there is a need for a micro-pump which has one or more of the following features: (a) it is capable of creating a steady and defined fluid flow path which may be nonlinear; (b) it is capable of causing fluid to flow at a high velocity; (c) it is capable of creating the fluid flow path without causing the fluid to evaporate or to be heated; and (d) it is capable of causing the fluid to flow without the use of moving parts.

SUMMARY

Among the embodiments of the micro-pump herein described, the first includes an array containing a plurality of conductive elements. A plate covers the array and a controller supplies and controls current to the conductive elements in the array. In this embodiment, the plate can be, and preferably is, a photopolymer. Moreover, if a photopolymer is used, it is preferable to use a thin-film photopolymer having a sub-millimeter thickness.

The conductive elements can have a current individually and sequentially applied therethrough or shut-off thereto by the controller. In addition, the controller operates to temporarily apply current to substantially all of the conductive elements in the array thereby enabling a fluid disposed on the plate to be separated into positively and negatively charged fluid molecules. Following this separation, the controller applies a current sequentially through selective of the conductive elements and shuts-off current thereto in a predetermined order to define a fluid flow path.

A fluid disposed on the plate and separated into positively and negatively charged molecules is forced to move along the fluid flow path by a moving electromagnetic field generated by the application of current and shutting-off of current to the selective of the conductive elements. Moreover, the fluid follows the direction of the moving electromagnetic field.

A second embodiment of a micro-pump includes a first array, containing a plurality of conductive elements, covered by a first plate. In addition, the micro-pump includes a second array, also containing a plurality of conductive elements, which is covered by a second plate. The first array is substantially parallel to the second array and the first and second plates are preferably photopolymers. Moreover, the first plate preferably abuts the second plate in such a fashion that microtubes are defined between therebetween.

The micro-pump also includes a controller which supplies and controls current to the conductive elements in the first and second arrays. In this embodiment, the conductive elements in the first and said second arrays can have a current individually and sequentially applied therethrough or shut-off thereto by the controller. Moreover, the current supplied to the second array is supplied in an opposite direction relative to the direction of the current supplied to the first array.

All of the conductive elements in the first and second arrays may have a current temporarily applied therethrough thereby enabling a fluid disposed between the arrays to be separated into positively and negatively charged fluid molecules. When selective of the conductive elements in the first and second arrays have a current sequentially applied thereto and shut-off thereto a fluid disposed between the arrays (and separated into positively and negatively charged molecules) is forced to move in a predetermined direction.

This invention also contemplates a method of generating fluid flow. The method involves creating, in a fluid, at least one working layer which contains a plurality of like-charged fluid molecules. An electromagnetic field encompassing the fluid is moved in a predetermined direction thereby creating at least one moving electromagnetic field; the moving electromagnetic field causes the fluid to move in the predetermined direction. In this method, the step of creating at least one working layer in a fluid includes applying (for a predetermined period of time) a current to a first array of elements to create a first steady electromagnetic field across the fluid and thereby a first working layer. Moreover, the step of moving the at least one steady electromagnetic field includes shutting-off the current to most of the first array elements and applying current to and shutting-off current to selected first array elements to create a first moving electromagnetic field.

Creating at least one working layer in a fluid may involve applying a current to a second array of elements to create a second steady electromagnetic field; the current applied to the second array preferably travels in a direction approximately opposite to the direction traveled by the current applied to the first array. Creating the at least one working layer may also involve applying the second steady electromagnetic field to the fluid to create a second working layer. The second array of elements is preferably substantially parallel to the first array of elements. In this fashion, the charge of the fluid molecules concentrated at the interface of the fluid and the second plate is the opposite of the charge of the fluid molecules concentrated at the interface of the fluid and the first plate.

Moving the electromagnetic field involves shutting-off the current to most of the second array elements and applying current to and shutting-off current to selected second array elements to create a second moving electromagnetic field. The application of current to and shutting-off current to select of the second array of elements occurs at substantially the same frequency as the step of applying current to and shutting-off current to select of the first array of elements. The first and the second moving electromagnetic fields move in substantially the same direction.

In this method, as fluid is moved through a microchannel or microtube, it may be replaced by new fluid. Accordingly, the method may involve replacing the fluid (which was moved in the direction of the at least one moving electromagnetic field) with new fluid. If the new fluid is to be moved, a current must be applied to some of the elements in the first array of elements to create a new steady electromagnetic field. The new steady electromagnetic field is applied to the new fluid to create at least one new working layer which contains a plurality of like-charged fluid molecules. Similar to the aforementioned steps regarding the original fluid, the current to those charged elements is shut-off and current is then cyclically applied to and shut-off to selected elements in the first array of elements to create a moving new electromagnetic field. The moving new electromagnetic field causes the charged new fluid molecules to flow in the direction of the moving new electromagnetic field.

A structural understanding of the aforementioned embodiments of the micro-pump as well as the method for generating fluid flow will be easier to appreciate when considering the detailed description in light of the figures hereafter described.

BRIEF DESCRIPTION OF THE DRAWINGS

The accompanying figures, which are incorporated in and constitute a part of the specification, illustrate presently preferred embodiments of the invention. Together with the above general description and the following detailed description, the figures serve to explain the principles of the invention.

FIG. 1(*a*) is a side view of a fluid, comprised of positively and negatively charged molecules, positioned above an array according to one embodiment of the invention;

FIG. 1(*b*) is a perspective view of the array in FIG. l(*a*) having current flow in one direction therethrough creating an electromagnetic field therearound;

FIG. 1(*c*) is a side view of the fluid in FIG. 1(*a*) showing how positively charged fluid molecules become concentrated near the array;

FIG. 3(*b*) is a side view of the fluid in FIG. 3(*a*) at a later time showing how the velocity profile of the fluid is broadened;

FIG. 4(*b*) is a side view of an infinitely long array of conductive elements one end of which is exposed to fluid which has been drawn into the micro-pump after the fluid previously in the micro-pump was moved by the moving electromagnetic field;

FIG. 5(*b*) is a side view of the two substantially parallel arrays of FIG. 5(*a*) between which is located a fluid comprised of positively and negatively charged molecules;

FIG. 5(*c*) is a side view of the two substantially parallel arrays of FIG. 5(*b*) and shows that when the arrays have been oppositely charged the positively charged fluid molecules concentrate near one of the arrays whereas the negatively charged fluid molecules concentrate near the other array;

FIG. 5(*d*) is a side view of the two substantially parallel arrays of FIG. 5(*c*) and shows how two velocity profiles are created in the fluid when a moving electromagnetic field is generated around each of the arrays;

FIG. 8(*b*) is an end view of the embodiment shown in FIG. 8(*a*) showing photopolymer microtubes between two conductive element arrays;

FIG. 9(*b*) is a top view of a microchannel having two 90° turns therein whereas the conductive elements are not positioned so as to follow the turns in the microchannel.

DETAILED DESCRIPTION OF THE PREFERRED EMBODIMENT

Figure 2:
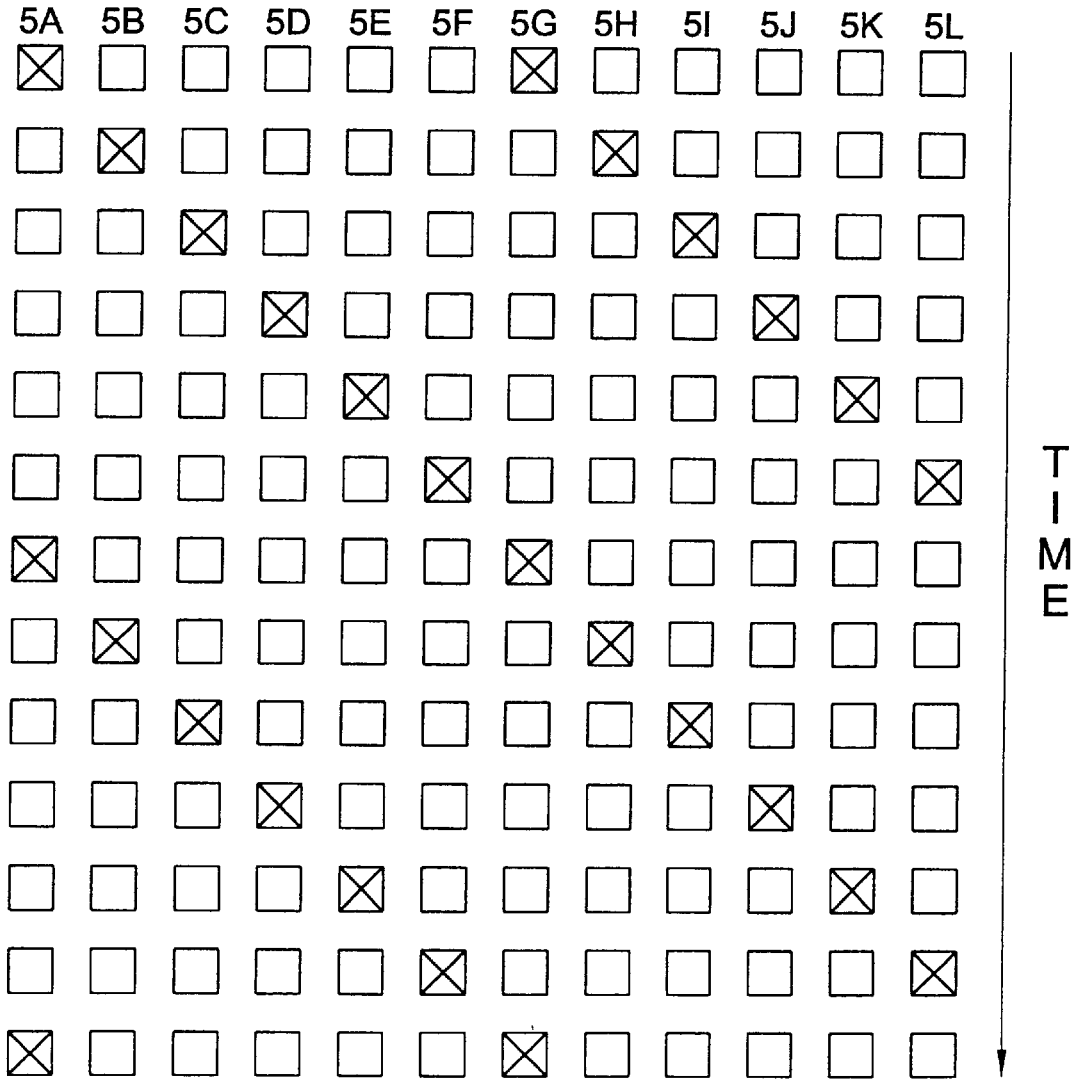
FIG. 2 is a side view of the array in FIG. 1(*a*) shown at twelve time intervals which depict how particular conductive elements may be systematically charged and discharged.

Although many pumps can be used to move a fluid from a first point to a second point, there is added value if the user could also could force fluid to pass through a third point on its way to the second point. There are many reasons for this. For example, a fluid stored in a container may need to be heated prior to its use (e.g. ink may need to be heated before its use in a thermal inkjet printer). Further, sending the fluid through another point would aid in adding necessary components to the fluid (such as diluting liquid being added to ink).

Solutions to one or more of the aforementioned deficiencies in the art can be obtained by various embodiments of the micro-pump herein described. Embodiments of this invention uses conductors rather than resistors to initiate fluid flow. A moving electromagnetic field is created by applying current to, and shutting-off current to, selective conductors at a high frequency. This application and shutting-off of current forces fluid molecules, separated by charge, to flow in a predetermined direction.

FIG. 1(*a*) shows a side view of a fluid generally designated at 1. The fluid 1 is comprised of positively charged molecules 2 (represented as black dots) and negatively charged molecules 3 (represented as white dots). The fluid 1 is shown above an array 4 of micro-pump conductive elements 5. When a current is simultaneously applied to each of the conductive elements 5, a steady state electromagnetic field is generated about the array 4 as shown in FIG. 1(*b*). When this occurs, the molecules 2, 3 in the fluid are divided according to their charge thereby forming a working layer 6. For descriptive purposes, a conductive element 5 having no current flowing therethrough is shown as a white box, a conductive element 5 having a current flowing therethrough which produces a clockwise electromagnetic field (using the "right hand rule" well known in the art) is represented by a black box, and a conductive element 5 having a current flowing therethrough which produces a counterclockwise electromagnetic field is represented by a white box having an "x" therein.

Figure 7:
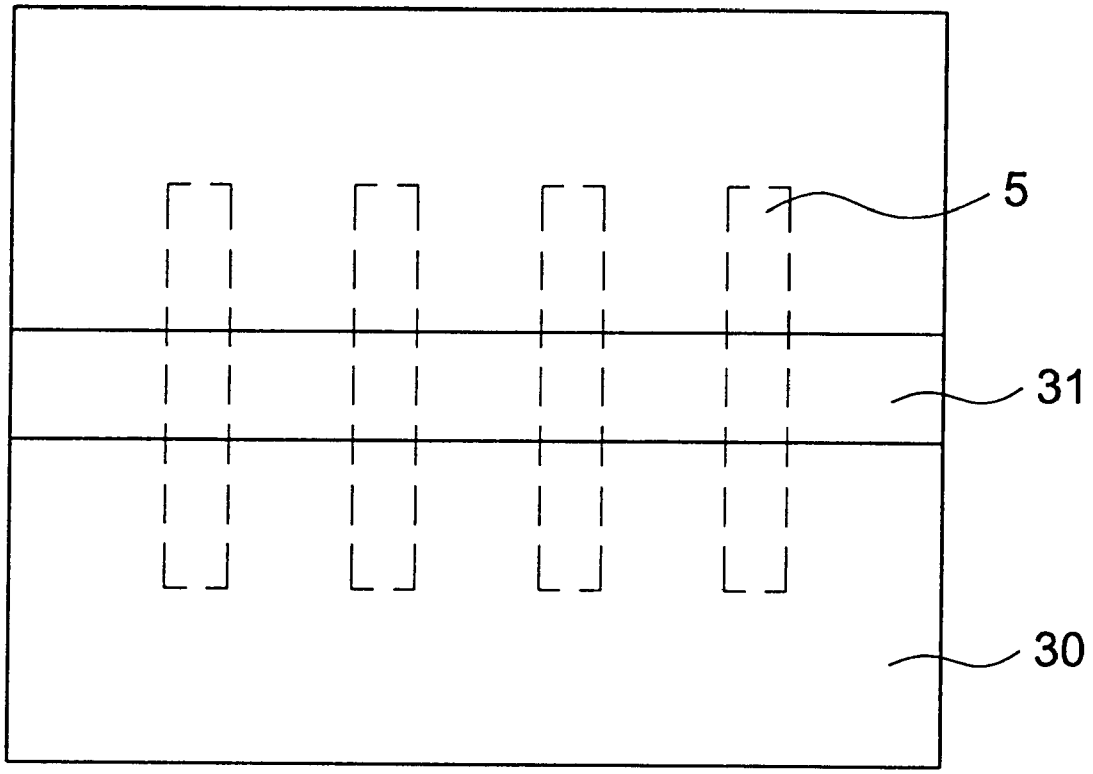
FIG. 7 is a top view of one embodiment of the invention showing a conductive element array covered by a photopolymer having microchannels etched therein.

As shown in FIG. 7, the conductive elements 5 are covered by a plate 30 that defines microchannels 31 in which fluid is forced to flow. By way of example, but not by way of limitation, the plate 30 could be formed using photopolymer materials. In a preferred embodiment, the plate 30 is formed from a photopolymer which is a dry-film (although it is also possible to use liquid-form) photo-imageable polyamide material having a sub-millimeter thickness; the dry-film is laminated onto the conductive elements 5. Dry-film photopolymers, such as the Parad brand photopolymer dry-film, are obtainable from E. I. duPont de Nemours and Company, Wilmington, Del.

Figure 9A:
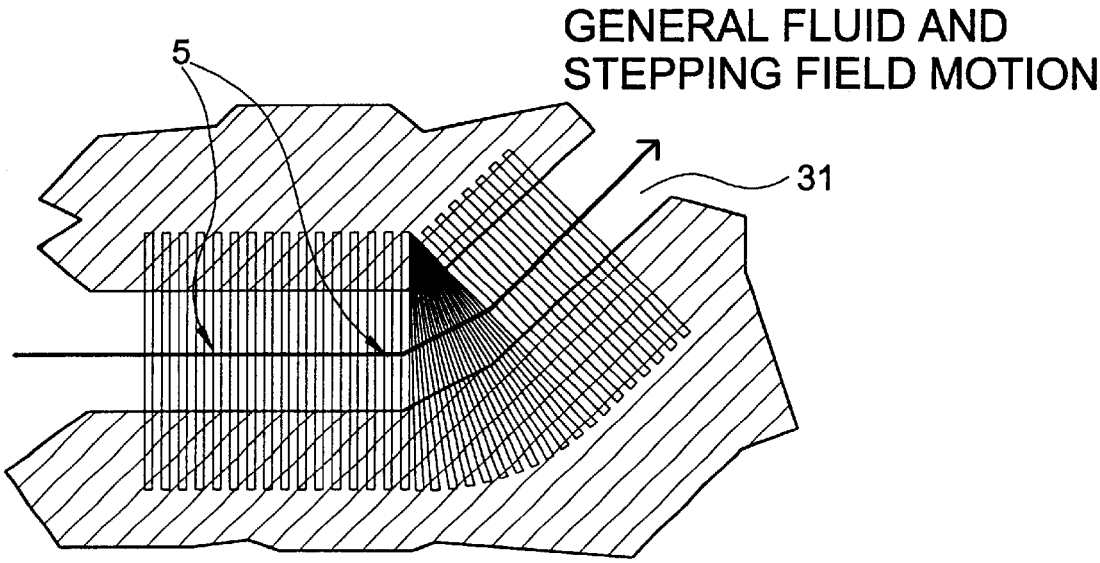
FIG. 9(*a*) is top view of a microchannel showing how conductive elements in an array can be positioned so as to follow the turns in the microchannel.
Figure 9B:
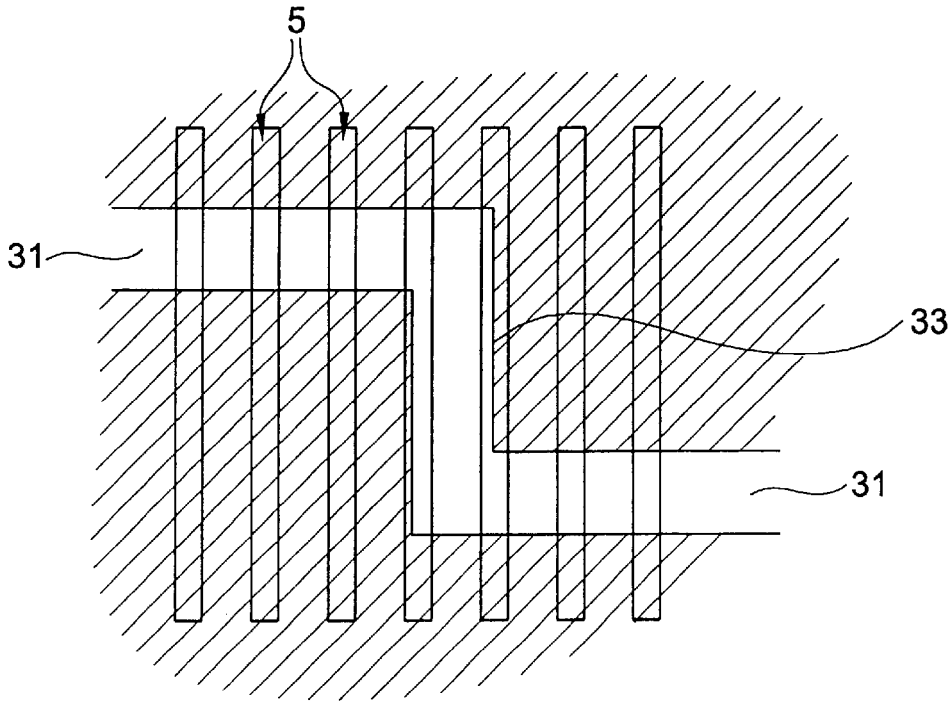

In accordance with standard micro-electronic component construction processes, portions of the dry-film photopolymer structure 30 are then exposed to ultraviolet light using photo-masks and are etched to define microchannels 31 in which the fluid may flow. The microchannels 31 typically have a depth on the order of 0–50 $\mu$m. As shown in FIG. 7, these microchannels 31 can be of varying shape and width and may intersect. The direction of the fluid flow is determined by conductive elements 5 which underlie particular microchannels 31 as shown in FIG. 9(*a*). The microchannels 31 through which fluid 1 will flow is determined by the direction of the moving electromagnetic field hereafter discussed. It should be noted that it is difficult to make the fluid turn around a 90° angle in a microchannel 31 as the inertial forces of the fluid 1 will direct the fluid 1 at the far wall 33 of the microchannel 31 into which the fluid is directed (as shown in FIG. 9(*b*)). However, it may be possible using the teachings of FIG. 9(*a*) to overcome the deficiencies of FIG. 9(*b*); in one embodiment, this would be implemented by an arrangement of small conductive elements oriented with respect to one another in such a manner as to follow the turn of the angle.

In the example shown in FIG. 1(*c*), in which current is travelling out of the page, positively charged fluid molecules 2 are drawn toward the interface of the plate 30 (covering the array 4 of conductive elements 5) and the fluid 1. As the positively charged fluid molecules 2 become more concentrated in the vicinity of the array 4, a working layer (shown generally at 6) is created. The time necessary to create the working layer 6 will depend on the volume of fluid 1 which needs to be separated and on the strength of the electromagnetic field applied thereto. A user will know that the working layer 6 is established based on standard fluid dynamics equations using variables such as the fluid's 1 density and viscosity, the depth of the microchannel 31, the density of the conductive elements 5 (i.e., how close the microelements 5 are to each other), the amount of current applied to the conductive elements 5 (which impacts the strength of the electromagnetic field), etc. Moreover, the electromagnetic field's characteristics will be governed by the BiotSavart law and the movement of the charged molecules 2, 3 caused by the coefficient of friction of small particles will be governed by Stokes'law.

Once this working layer 6 is established, the current through most of the conductive elements 5 in the array 4 is shut-off. Rather than allow the charged fluid molecules 2, 3 to become evenly mixed once again through molecular diffusion, current is applied to select conductive elements 5. By sequentially driving current through (and shutting-off the current to) the selected conductive elements 5, a moving electromagnetic field can be created. For example, (as shown in FIG. 2) if an array 4 has twelve conductive elements 5 designated 5A–5L and elements 5A and 5G initially have current driven therethrough (after the current to all of the conductive elements 5A–5L is shut-off), successively driving current through elements 5B and 5H (and shutting-off the current to elements 5A and 5G) will cause a step-like shift in the electromagnetic field. Moreover, subsequently driving current through elements 5C and 5I (and shutting-off the current to elements 5B and 5H) will cause another step-like shift in the electromagnetic field. This will be followed by the following combinations of driving current through conductive elements 5 and shutting-off current to conductive elements 5:

| driving through | shutting-off |
|---|---|
| 5D, 5J | 5C, 5I |
| 5E, 5K | 5D, 5J |
| 5F, 5L | 5E, 5K |
| (starting point) 5A, 5G | 5G, 5L. |

Accordingly, successively applying current and shutting-off current to the elements 5 will cause a periodic step-like shift in the position of the electromagnetic field. By increasing the frequency of this iterative process, the period of the step in the step-like shift will approach zero, thereby yielding essentially a continuously moving electric front and corresponding moving electromagnetic field. The moving electromagnetic field maintains the separation in the fluid 1 between the positively and negatively charged fluid molecules 2, 3.

The example above is in no ways limiting. Of course, any number of elements 5 can have current driven therethrough with the current in other elements 5 simultaneously shut-off. The array can have as many elements as needed by the user to generate the fluid flow desired. In some situations, it may even be preferable to drive current through (and correspondingly shut-off the current to) only one conductive element 5 at a time.

Figure 10:
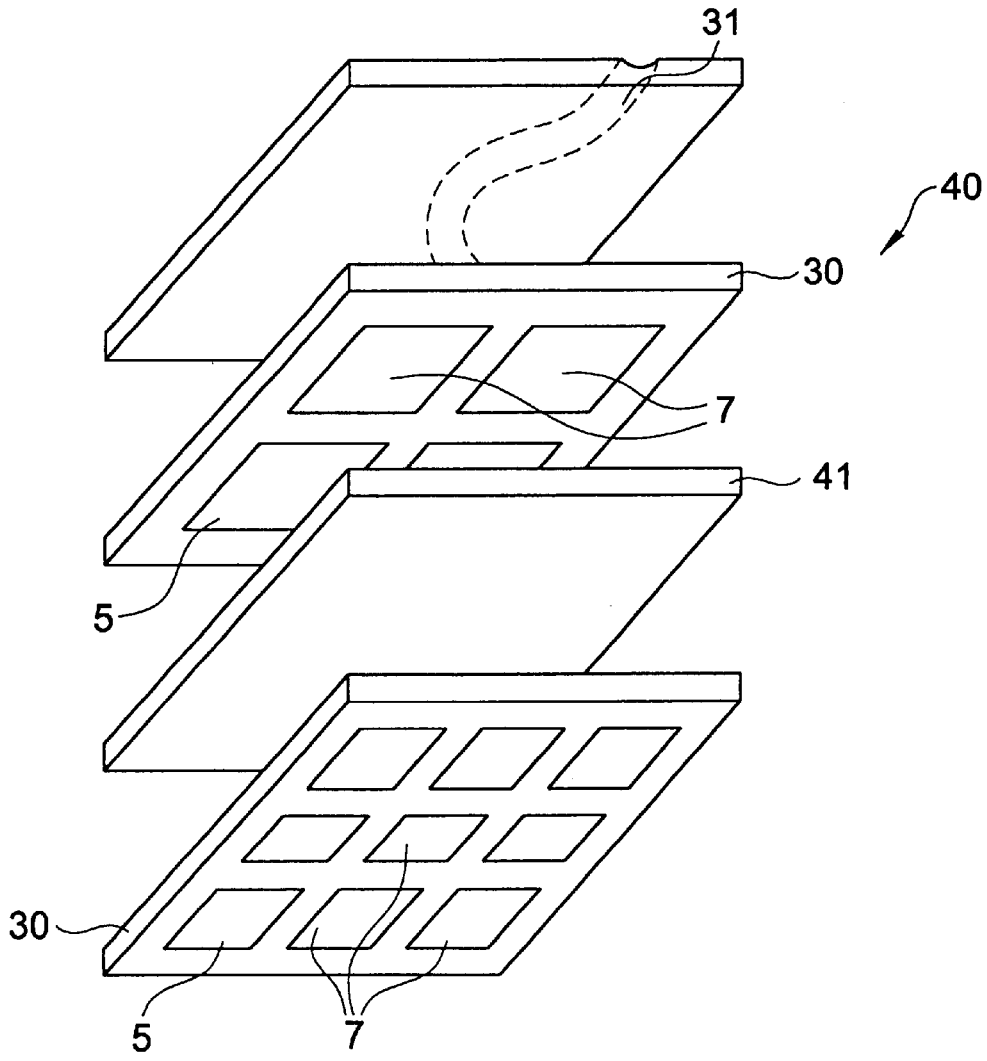
FIG. 10 is an exploded underside perspective view of a matrix of conductive elements arranged in multiple layers of plates.

The example above uses one array to pull a fluid 1 along a particular path which can be linear or curved (as shown in FIG. 9(*a*). It is also possible, however, to use a matrix 7 of conductive elements 5 to generate a two dimensional flow pattern, as shown in FIG. 10. If a matrix 7 of conductive elements 5 is to be used, all of the conductive elements 5 would be subject to a predetermined sequence by which current is applied to and shut-off from particular conductive elements 5 by means of a controller 100. The greater the density of the matrix 7 (i.e. the number of conductive elements 5 per unit space), the better the ability to control fluid flow. However, as the number of conductive elements 5 in the matrix gets larger, it becomes more difficult to ground each element 5. Accordingly, one solution to this problem is to connect all of the ground leads of the conductive elements 5 in a particular area to form a primitive. Also helpful is using a multi-layer plate 40 arrangement in which conductive elements 5 in each layer 30 are electrically isolated from the conductive elements 5 in any other layer by means of a nonconductive material 41 (e.g. silicon carbides or silicon oxides) being deposited between the layers 30.

Figure 3A:
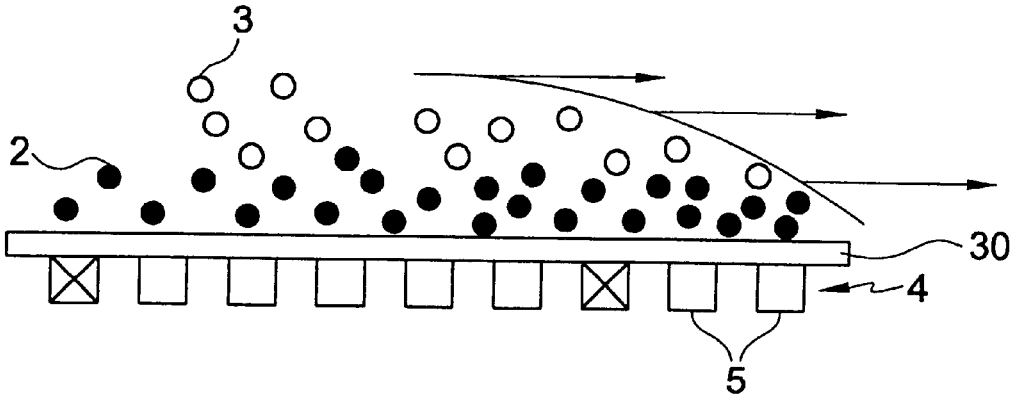
FIG. 3(*a*) is a side view of the fluid in FIG. 1(*a*) being pulled by a moving electromagnetic field thereby creating a velocity profile in the fluid.
Figure 3B:
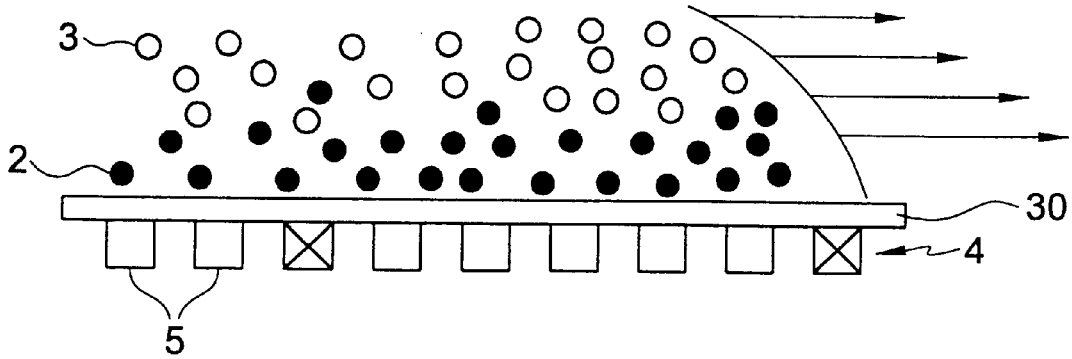

The moving electromagnetic field causes charged fluid molecules in the working layer 6 to be pulled in the direction of the electromagnetic field. The movement of those molecules defines a velocity profile (as shown in FIG. 3(*a*). In turn, those charged fluid molecules pull (due to both shear effects and electrical attraction) oppositely charged fluid molecules located outside of the working layer 6. In this fashion, both positively and negatively charged fluid molecules 2, 3 are pulled in the direction of the moving electromagnetic field thereby flattening the velocity profile (as shown in FIG. 3(*b*).

In time, the velocity profile becomes flatter (as shown in FIG. 3(*b*) as the inertia of the fluid molecules, which would otherwise keep the fluid molecules at rest, is overcome by the effects of the viscous shear. In addition or in the alternative, a flatter velocity profile can also be achieved by using a greater number of conductive elements 5 or by increasing the current to the conductive elements 5 to which a current is applied to thereby strengthen the electromagnetic field.

Figure 4A:
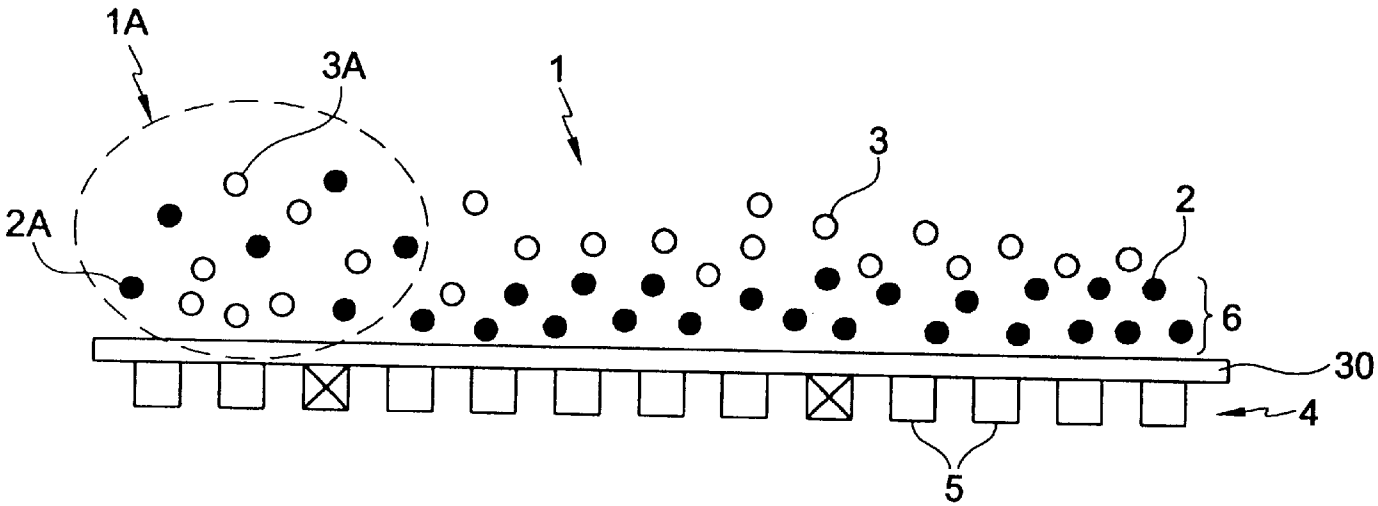
FIG. 4(*a*) is a side view of an end of an array of conductive elements exposed to fluid which has been drawn into the micro-pump after the fluid previously in the micro-pump was moved by the moving electromagnetic field.
Figure 4B:
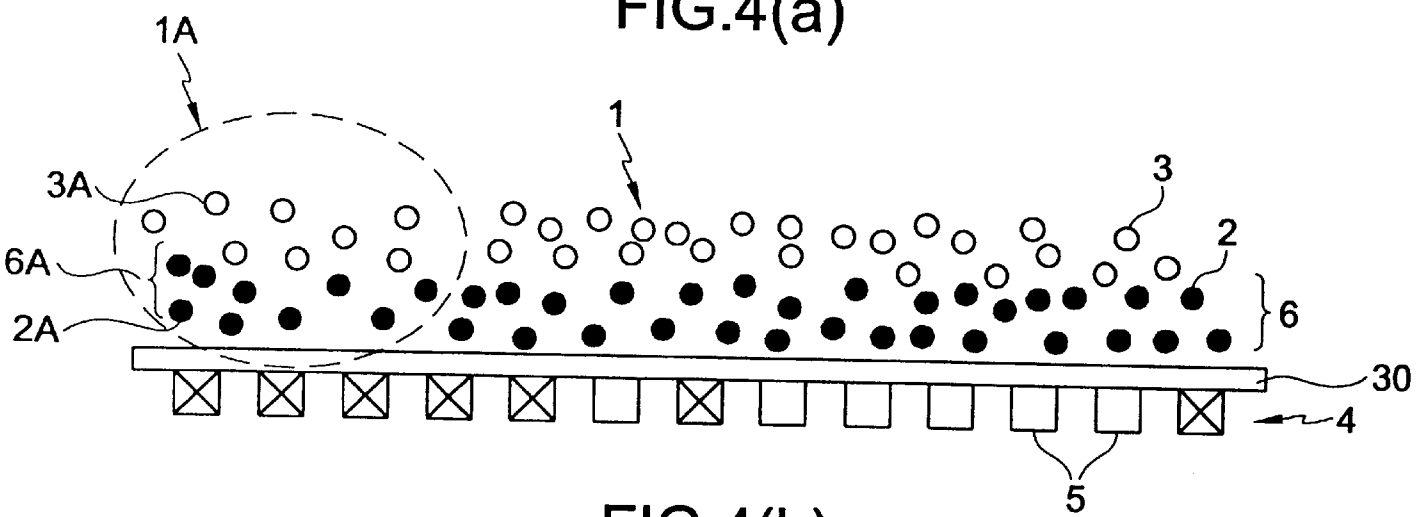
Figure 5A:
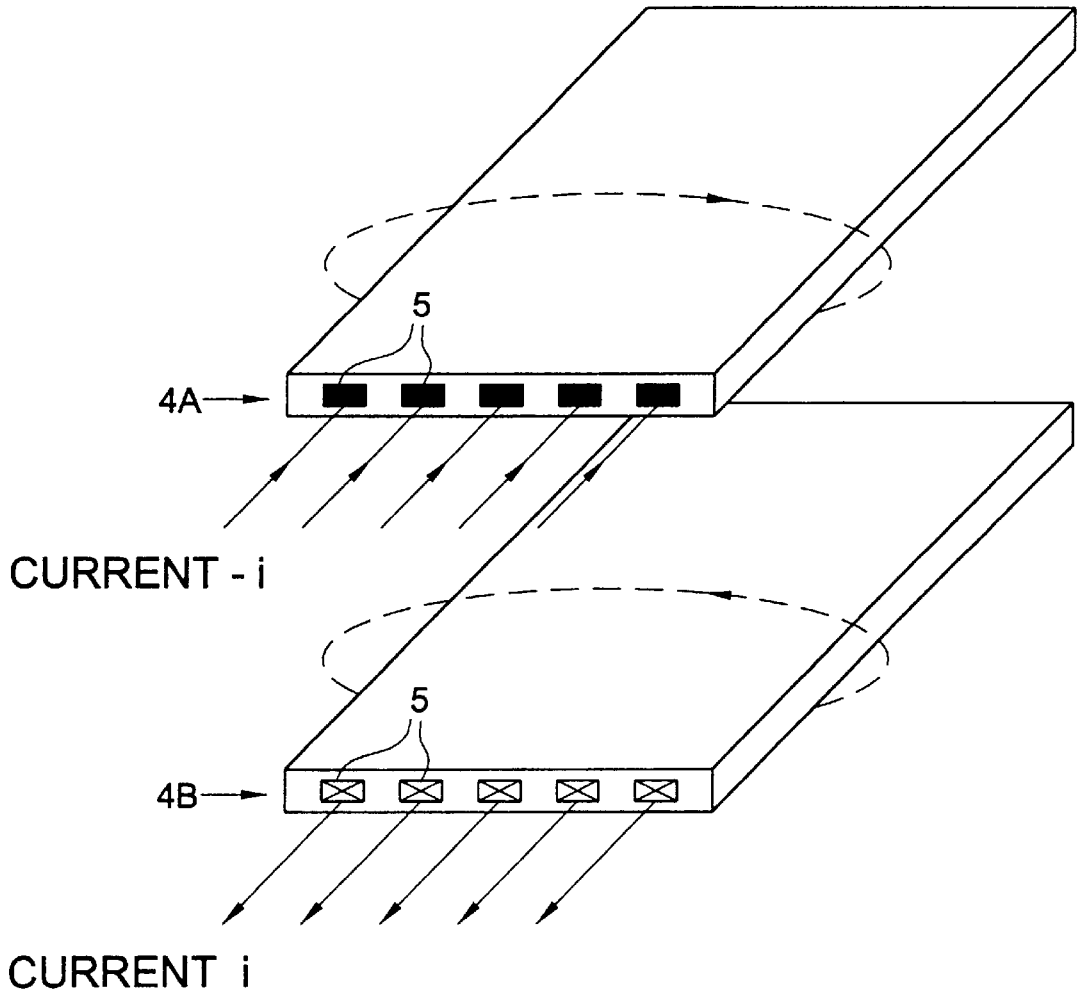
FIG. 5(*a*) is a perspective view of two substantially parallel arrays having an opposite charge thereby creating two opposed electromagnetic fields.
Figure 5B:
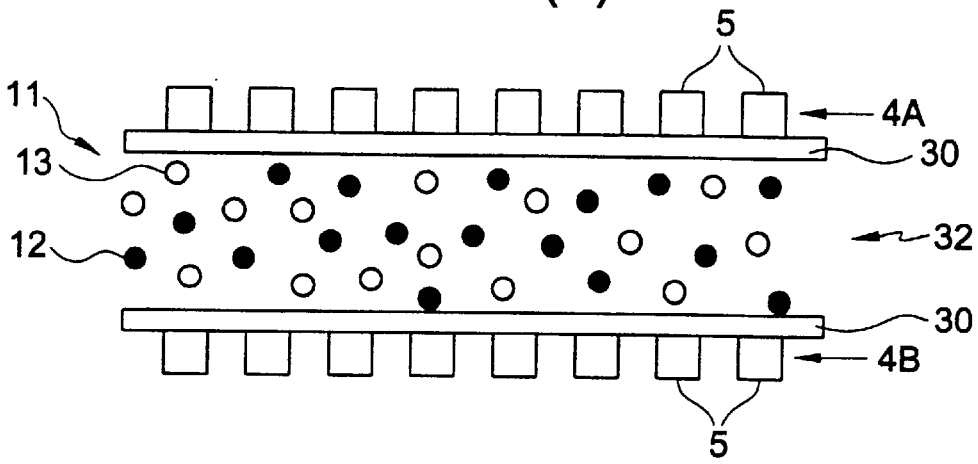
Figure 5C:
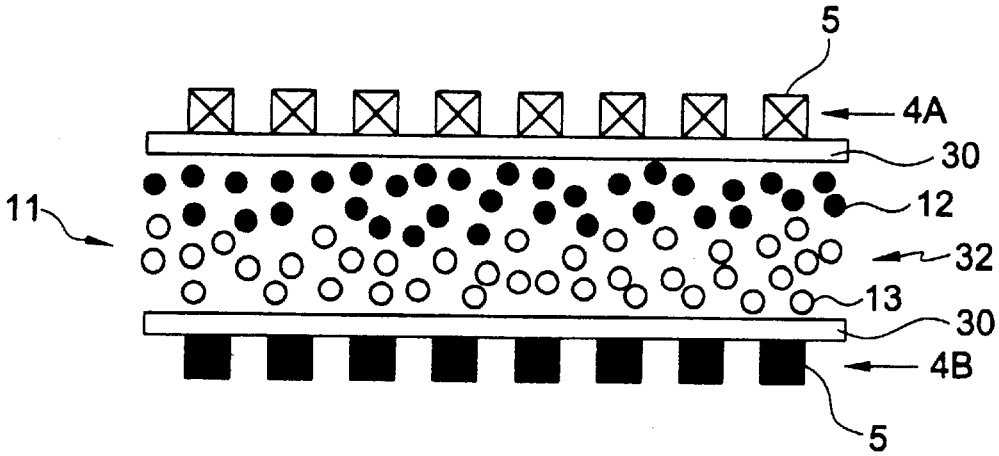
Figure 5D:
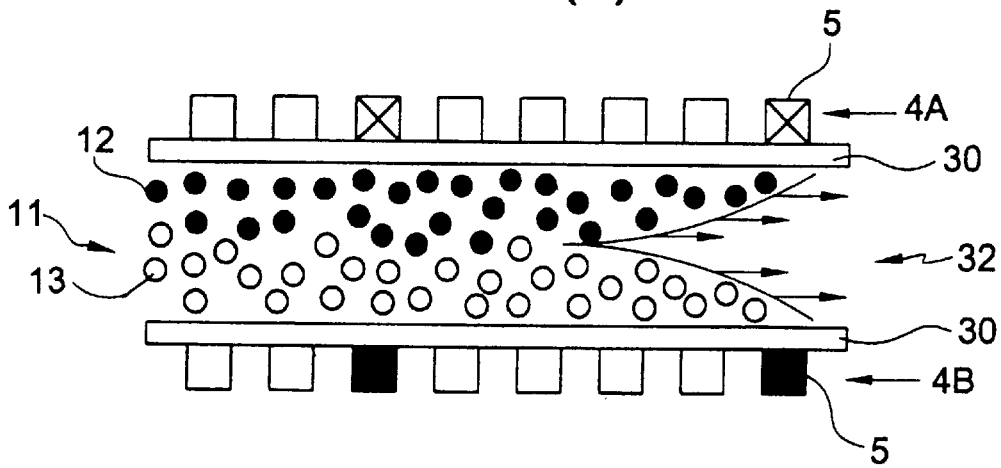

As the fluid 1 is pulled in the direction of the moving electromagnetic field, it will be replaced by new fluid 1A, as shown in FIG. 4(*a*). However, unlike the original fluid 1 which, at this point, has been separated into positively charged fluid molecules 2 and negatively charged fluid molecules 3, the positively charged fluid molecules 2A and negatively charged fluid molecules 3A in the new fluid 1A will be intermixed similar to those fluid molecules 2, 3 in the original fluid 1 prior to the charging of all of the conductive elements 5 in the array 4. To separate the new positively charged fluid molecules 2A from the new negatively charged fluid molecules 3A (and thereby recreate working layer 6), current needs to be driven through some of the conductive elements 5 in the array 4 as previously described, as shown in FIG. 4(*b*).

If current is applied to all of the conductive elements 5 in the array 4, the moving electromagnetic field will be decelerated at best and may be irreparably disturbed at worst. The goal, therefore, is to recreate the working layer 6 while providing a minimum net deceleration effect on the fluid 1 already in motion. Of course, current must be driven through those conductive elements 5 adjacent the new fluid 1A. The extent to which current must be driven through other elements 5 in the array, which are farther from the new fluid 1A, depends on the length of the array 4, the density of the conductive elements 5 in the array 4, and the amount of new fluid 1A being supplied thereto. Of course, as the array gets longer, the percentage of conductive elements 5 in the array which would need to have current driven through them would decrease as would the deceleration effect on the moving electromagnetic field.

Once the new fluid 1A is separated into positively charged fluid molecules 2A and negatively charged fluid molecules 3A and a new working layer 6A is established, the high-frequency sequential application of current to, and shutting-off of current to, the conductive elements 5 can occur as previously described. Reestablishing the moving electromagnetic field will pull the new fluid 1A in the direction of the moving electromagnetic field as previously described.

Figure 8A:
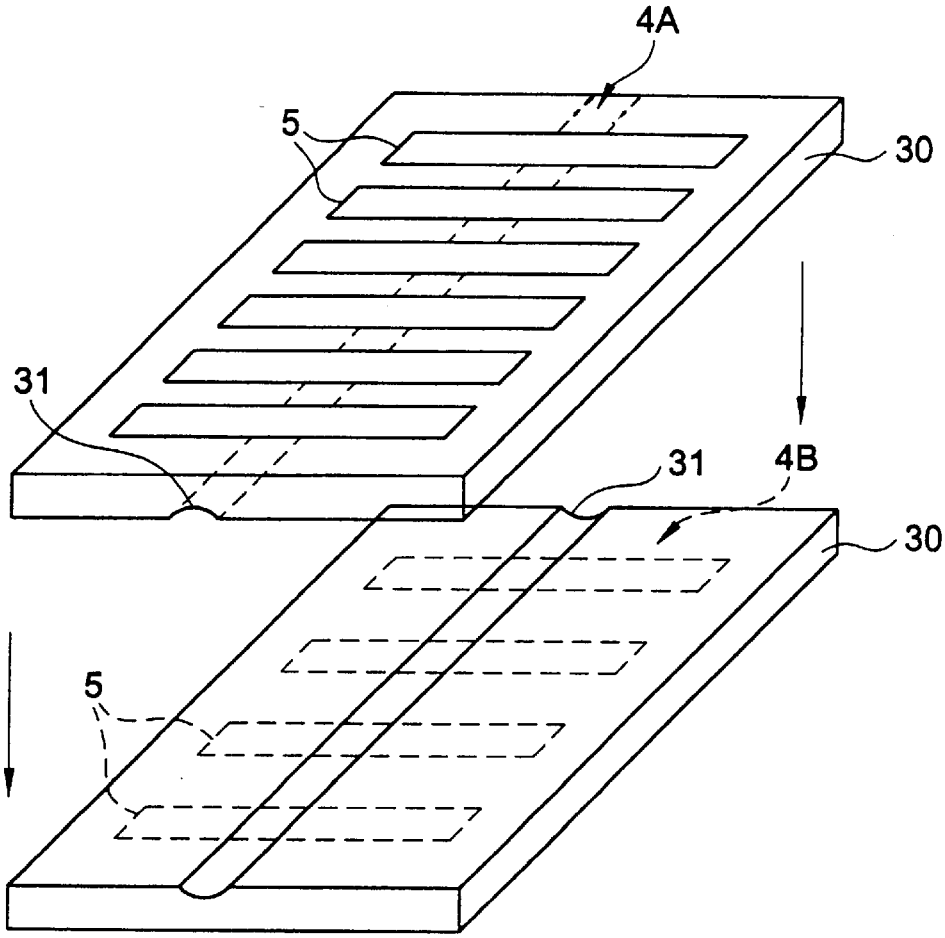
FIG. 8(*a*) is a perspective view of one embodiment of the invention showing two conductive element arrays each of which is covered by a photopolymer between which are defined microtubes.
Figure 8B:
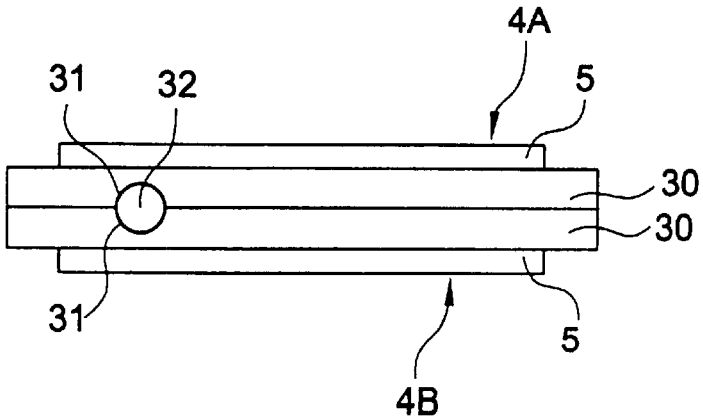

FIG. 8(*a*) shows a perspective view of two parallel plates 30 (which cover arrays 4A, 4B) shown in a separated state, whereas FIG. 8(*b*) shows the parallel plates 30 in contact with each other, forming a series of microtubes 32 according to a second embodiment of the micro-pump. This second embodiment incorporates one array 4A with current driven through the conductive elements 5 thereof in one direction, and another array 4B with current driven through the conductive elements 5 thereof in the direction opposite to the direction in which the current is driven through the conductive elements 5 in the other array 4A, as shown in FIG. 5(*a*).

In this embodiment the two arrays 4A, 4B (each of which is covered by a plate 30 which is preferably a photopolymer) are spaced generally parallel to each other. Whereas in the previous embodiment, shown in FIGS. 1(*a*) and l(*c*), the plate 30 deposited on the array 4 defined microchannels 31, in this embodiment two plates 30 abut each other to define microtubes 32. By directing current in one direction through one of the arrays 4A and in the opposite direction through the other array 4B, two opposite electromagnetic fields are created, as shown in FIG. 5(*a*).

As shown in FIGS. 5(*b*) a fluid 11 which is in-between the parallel arrays 4A, 4B will initially contain inter-mixed positively charged fluid molecules 12 and negatively charged fluid molecules 13. However, as shown in FIG. 5(*c*), the fluid 11 located between the array 4A, 4B will, similar to the fluid 1 previously discussed, be separated into positively charged fluid molecules 12 and negatively charged fluid molecules 13. However, in this embodiment the positively charged fluid molecules 12 will approach and concentrate near the plate 30 covering one of the arrays 4A in which current flows in one direction, whereas the negatively charged fluid molecules will approach and concentrate near the plate 30 covering the other array 4B in which current flows in the opposite direction.

As previously described, a step-like charging of the elements 5 in the arrays 4A, 4B simultaneously occurs in the same direction, so that a moving electromagnetic field generated by one of the arrays 4A will pull the positively charged fluid molecules 12, whereas the moving electromagnetic field generated by the other array 4B will pull the negatively charged fluid molecules 13 in the same direction. In this fashion and as shown in FIG. 5(*d*), two velocity profiles will be generated and will move in the same direction. Accordingly, as two moving electromagnetic fields are acting on the same fluid 11, the velocity of the fluid can be more readily increased.

Selectively applying and shutting-off current to the conductive elements 5 in the arrays 4, 4A, 4B is accomplished by means of a controller. Many controllers well known in the art are capable of selectively (and sequentially) creating a voltage potential across particular resistors in a series of resistors. Similar circuit protocols can be used to selectively (and sequentially) apply a current to an array 4 of conductive elements 5. For example, U.S. Pat. Nos. 5,517,224, 5,541,629, 5,815,180, 5,835,112, and 5,874,974, all of which are incorporated herein by reference, disclose control circuits which can easily be adapted by one of ordinary skill in the art to create a control circuit for the presently described invention.

Figure 6:
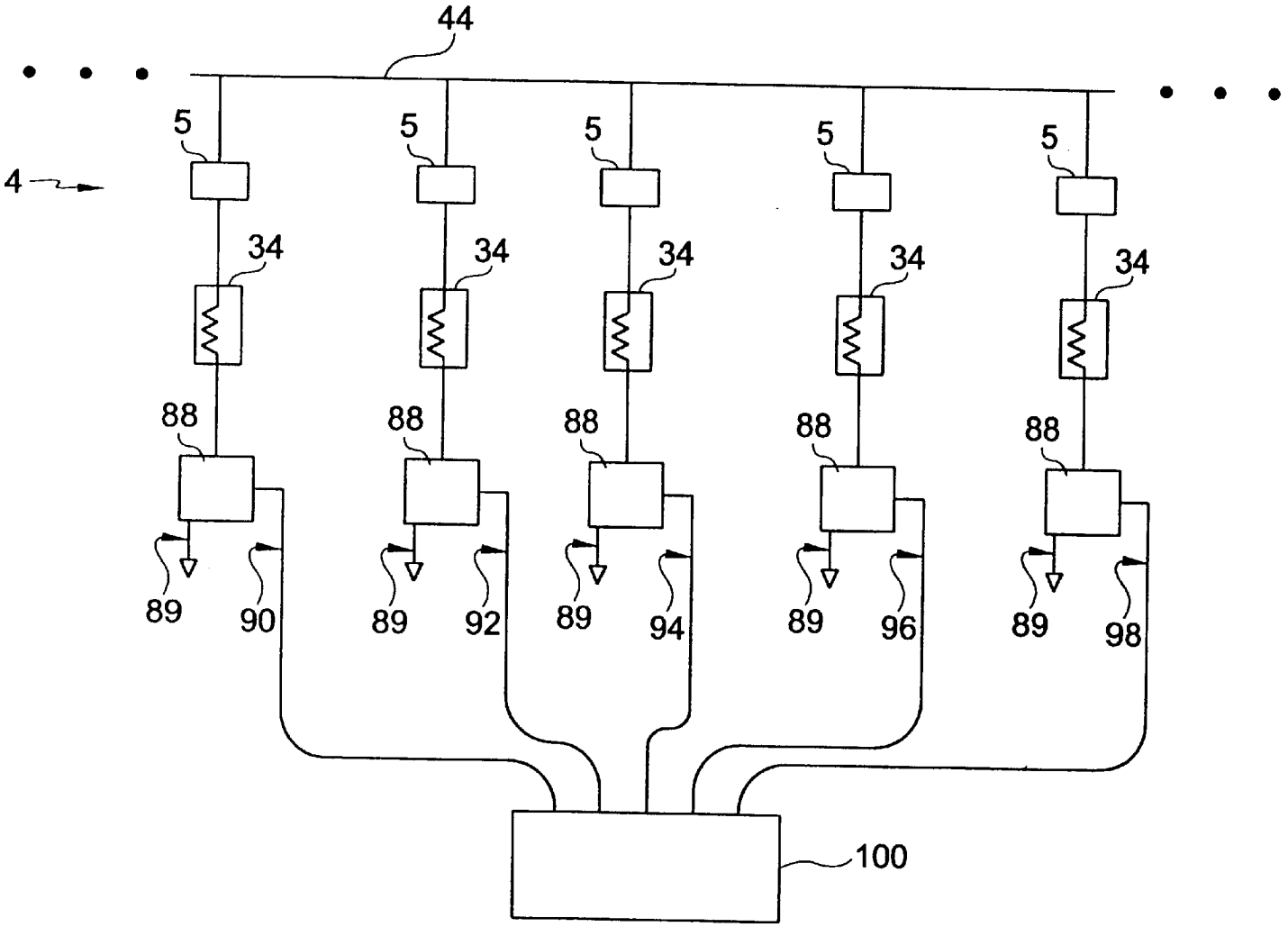
FIG. 6 is a circuit diagram showing a series of switching devices which are controlled by a controller and which are electrically connected via a resistor to a conductive element.

With reference to FIG. 6, control lines 90, 92, 94, 96, 98 from a controller 100 are connected to a series of switching devices 88. The switching devices 88 are connected between resistors 34 and a first supply terminal 89. Opposite the switching devices across the resistors 34 are positioned the conductive elements 5 of the arrays 4, 4A, 4B. The control lines 90, 92, 94, 96, 98 connected to the switching devices 88 are used to selectively switch the switching devices 88 between a conducting mode and a non-conducting mode. In the preferred embodiment, the switching devices 88 are MOS transistors, and a supply voltage is connected across the main contact point 44 and the first supply terminal 89.

Information relating to which conductive elements 5 are to have current driven therethrough or current shut-off therefrom in one embodiment may be stored in a computer memory or decoding matrix. Based on the information stored in the computer or decoding matrix, switching devices 88 are discretely turned on-and-off to allow current to flow through a particular resistor 34 and into a conductive element 5. The sequence by which the conductive elements 5 are to have current applied thereto and shut-off therefrom may be stored in the memory or decoding matrix and may be cycled using a shift register. Ideally, the period of the cycle of the shift register is as small as possible.

As the period of the shift register approaches zero, the movement of the electromagnetic field becomes more continuous. The more continuous the movement of the electromagnetic field, the more stable the velocity profile and fluid flow pattern. The present preferred embodiment uses frequencies up to 41 kHz to cycle through the application of current and shutting-off of current to all of the conductive elements 5. Accordingly, the time needed to complete one cycle of current being applied and shut-off is 1/f (i.e., 1/41 kHz) or 24.3 $\mu$s. It is anticipated that this frequency will be increased to 72 kHz which would reduce the overall cycle time to 13.8 $\mu$s.

Any number of conductive elements can be used to practice the embodiments of the invention herein described. For instance, one skilled in the art could use any type of metal which has good electricity conduction properties and which can be deposited using conventional physical vapor deposition methods, including for example gold, silver, nickel as those metals have ample free electrons ready to favor electrical conduction. It is preferable, however, to use an aluminum/copper conductor.

Although the aforementioned described various embodiments of the invention, the invention is not so restricted. The foregoing description is for exemplary purposes only and is not intended to be limiting. Accordingly, alternatives which would be obvious to one of ordinary skill in the art upon reading the teachings herein disclosed, are hereby within the scope of this invention. The invention is limited only as defined in the following claims and equivalents thereof.

What is claimed is:

1. A micro-pump comprising:

an array containing a plurality of conductive elements;

a plate covering the array; and a controller for supplying and controlling a current to the conductive elements in the array, wherein said conductive elements can have a current individually and sequentially applied therethrough or shut-off thereto by the controller, wherein said controller operates to temporarily apply current to substantially all of the conductive elements in the array thereby enabling a fluid disposed on said plate to be separated into positively and negatively charged fluid molecules, wherein the controller then applies a current sequentially through selective of said conductive elements and shuts-off current thereto in a predetermined order to define a fluid flow path, and wherein a fluid disposed on said plate and separated into positively and negatively charged molecules is forced to move along the path.

2. The micro-pump according to claim 1, wherein the plate is a photopolymer.

3. The micro-pump according to claim 2, wherein the photopolymer is a thin-film having a sub-millimeter thickness.

4. The micro-pump according to claim 1, wherein the sequential application of current and shutting-off of current to said conductive elements occurs at a frequency up to 41 kHz.

5. The micro-pump according to claim 4, wherein the fluid is forced to move by a moving electromagnetic field generated by the application of current and shutting-off of current to the conductive elements.

6. The micro-pump according to claim 1, wherein the fluid is forced to move by a moving electromagnetic field generated by the application of current and shutting-off of current to said selective of said conductive elements.

7. The micro-pump according to claim 6, wherein the fluid, which is forced to move, follows the direction of the moving electromagnetic field.

8. The micro-pump according to claim 6, wherein the plate is a photopolymer which is a thin-film and which has a sub-millimeter thickness; and wherein the sequential application of current and shutting-off of current to all of said conductive elements occurs at a frequency up to 41 kHz.

9. A micro-pump comprising:

a first array containing a plurality of conductive elements;

a first plate covering said first array;

a second array containing a plurality of conductive elements;

a second plate covering the second array; and a controller for supplying and controlling a current to the conductive elements in the first and second arrays, wherein said conductive elements in said first and said second arrays can have a current individually and sequentially applied therethrough or shut-off thereto by the controller, wherein the first array is substantially parallel to the second array, wherein the current supplied to the second array is supplied in an opposite direction relative to the direction of the current supplied to the first array, wherein all of the conductive elements in said first and said second arrays may have a current temporarily applied therethrough thereby enabling a fluid disposed between said first and said second arrays to be separated into positively and negatively charged fluid molecules, and wherein when selective of said conductive elements in said first and said second arrays have a current sequentially applied thereto and shut-off thereto a fluid disposed between said first and said second arrays and separated into positively and negatively charged molecules is forced to move in a predetermined direction.

10. The micro-pump according to claim 9, wherein the first and the second plates are photopolymers.

11. The stepping-field elector-osmotic micro-pump according to claim 9, wherein the first plate abuts said second plate, and wherein microtubes are defined between said first and said second plates.

12. A method of generating fluid flow comprising the steps of:

(a) creating at least one working layer in a fluid, wherein the at least one working layer contains a plurality of like-charged fluid molecules; and (b) moving an electromagnetic field encompassing the fluid in a predetermined direction to create at least one moving electromagnetic field to cause the fluid to move in said predetermined direction.

13. The method of generating fluid flow according to claim 12, wherein the step of creating at least one working layer in a fluid includes the steps of:

(c) applying, for a predetermined period of time, a current to a first array of elements to create a first steady electromagnetic field across the fluid to create a first working layer;

and wherein the step of moving the at least one steady electromagnetic field includes the steps of:

(d) shutting-off the current to most of the first array elements; and (e) applying current to and shutting-off current to selected first array elements to create a first moving electromagnetic field.

14. The method of generating fluid flow according to claim 13, wherein the step of creating at least one working layer in a fluid includes the steps of:

(f) applying a current to a second array of elements to create a second steady electromagnetic field, wherein the current applied to the second array travels in a direction approximately opposite to the direction traveled by the current applied to the first array;

(g) applying the second steady electromagnetic field to the fluid to create a second working layer, wherein the second array of elements is substantially parallel to the first array of elements, wherein the charge of the fluid molecules concentrated at the interface of the fluid and the second plate is the opposite of the charge of the fluid molecules concentrated at the interface of the fluid and the first plate, and wherein the step of moving the electromagnetic field includes the steps of:

(h) shutting-off the current to most of the second array elements; and (i) applying current to and shutting-off current to selected second array elements to create a second moving electromagnetic field.

15. The method of generating fluid flow according to claim 14, wherein the first and the second moving electromagnetic fields move in substantially the same direction.

16. The method of generating fluid flow according to claim 14, wherein the step of applying current to and shutting-off current to selected of said first array of elements occurs at a frequency up to 41 kHz, and wherein the step of applying current to and shutting-off current to select of said second array of elements occurs at substantially the same frequency as the step of applying current to and shutting-off current to select of said first array of elements.

17. The method of generating fluid flow according to claim 13, wherein the step of applying current to and shutting-off current to select first array elements occurs at a frequency up to 41 kHz.

18. The method of generating fluid flow according to claim 13, further g the steps of:

(f) replacing the fluid which was moved in the direction of the at least one moving electromagnetic field with new fluid;

(g) applying a current to some of the elements in the first array of elements to create a new steady electromagnetic field;

(h) applying the new steady electromagnetic field to the new fluid to create at least one new working layer, wherein the at least one new working layer contains a plurality of like-charged fluid molecules;

(i) shutting-off the current to those elements charged in step (i); and (j) cyclically applying current to and shutting-off current to selected elements in said first array of elements to create a moving new electromagnetic field causing the charged new fluid molecules to flow in the direction of the moving new electromagnetic field.

* * * * *

UNITED STATES PATENT AND TRADEMARK OFFICE

CERTIFICATE OF CORRECTION

PATENT NO. : 6,460,974 B1
DATED : October 8, 2002
INVENTOR(S) : Lebron

It is certified that error appears in the above-identified patent and that said Letters Patent is hereby corrected as shown below:

Column 12,
Line 19, delete “g” and insert therefor -- comprising --.

Signed and Sealed this

Sixteenth Day of December, 2003

JAMES E. ROGAN
*Director of the United States Patent and Trademark Office*